US011944226B1

(12) United States Patent
Gartland

(10) Patent No.: US 11,944,226 B1
(45) Date of Patent: Apr. 2, 2024

(54) SHOWER CURTAIN HANGER

(71) Applicant: Jeffrey Alan Gartland, Rochester, NY (US)

(72) Inventor: Jeffrey Alan Gartland, Rochester, NY (US)

( * ) Notice: Subject to any disclaimer, the term of this patent is extended or adjusted under 35 U.S.C. 154(b) by 0 days.

(21) Appl. No.: 18/369,186

(22) Filed: Sep. 17, 2023

(51) Int. Cl.
*A47H 15/00* (2006.01)
*A47H 15/02* (2006.01)
*A47H 1/02* (2006.01)

(52) U.S. Cl.
CPC ..... *A47H 15/02* (2013.01); *A47H 1/02* (2013.01)

(58) Field of Classification Search
CPC ..... Y10T 24/3484; Y10T 24/3485; Y10T 24/3449; Y10T 24/3451; Y10T 24/3452; Y10T 24/51; F16B 2/12; A47H 13/00; A47H 13/01; A47H 13/02; A47H 13/04; A47H 13/06; A47H 13/16; A47H 15/00; A47H 15/02; A47H 15/04; A47H 1/02
USPC ..... 16/87, 87.2, 87.6 R, 91
See application file for complete search history.

(56) References Cited

U.S. PATENT DOCUMENTS 1,451,754 A 4/1923 Angevine
1,607,599 A * 11/1926 Angevine ..... A47H 15/02 16/87.8
2,045,007 A 1/1935 Carpenter
2,320,003 A * 5/1943 Madan ..... A47H 13/04 160/390
2,538,755 A * 1/1951 Bradley ..... A47H 15/02 74/25
3,550,184 A * 12/1970 Hachtel ..... A47H 13/14 16/87.2
7,003,848 B2 * 2/2006 Ho ..... A47H 13/04 16/87.8
8,875,770 B1 * 11/2014 Martin ..... A47K 3/38 160/124
9,578,995 B2 2/2017 Hanley
2003/0028998 A1 * 2/2003 Samelson ..... A47K 3/38 16/87 R
2007/0050904 A1 * 3/2007 Harwanko ..... A47K 3/38 4/558

(Continued)

FOREIGN PATENT DOCUMENTS

DE 2352935 A * 4/1975 ..... A47H 15/04
DE 20006191 U1 * 6/2000 ..... A47K 3/38

(Continued)

OTHER PUBLICATIONS

Keith Brigadier, Shower Curtain Hooks, Thingiverse.com, Feb. 5, 2018.

*Primary Examiner* — Chuck Y Mah
(74) *Attorney, Agent, or Firm* — Jong Patent Firm; Cheng Ning Jong; Tracy P. Jong

(57) ABSTRACT

A hanger for suspending a first article and a second article on a rod, the hanger including a U-shaped structure, a pair of prongs each extending from the U-shaped structure, a roller including a pair of opposingly disposed receptacles, each the receptacle configured to receive one of the prongs and a pair of hooks extending from the U-shaped structure, wherein the roller is coupled with the U-shaped structure by the pair of prongs about the rod to form a gap around the rod to enable rolling of the hanger along the rod with limited departure from the rod, the first article and the second article are each suspended by the pair of hooks.

14 Claims, 9 Drawing Sheets

(56) References Cited

U.S. PATENT DOCUMENTS

| | | | | |
|---|---|---|---|---|
| 2007/0261330 | A1* | 11/2007 | Liu | A47H 13/04 52/235 |
| 2007/0277355 | A1* | 12/2007 | Richardson | A47H 13/01 24/716 |
| 2019/0249708 | A1* | 8/2019 | Beyda | F16B 45/012 |
| 2021/0120994 | A1* | 4/2021 | Gwen | A47H 13/01 |

FOREIGN PATENT DOCUMENTS

| | | | | |
|---|---|---|---|---|
| EP | 235054 | A * | 9/1987 | A47H 13/01 |
| SU | 1391607 | A * | 4/1988 | |
| WO | WO-2016075441 | A1 * | 5/2016 | A47H 13/04 |

* cited by examiner

SHOWER CURTAIN HANGER

BACKGROUND OF THE INVENTION

1. The Field of the Invention

The present invention relates to hangers for shower curtains. More specifically, the present invention is directed to hangers capable of simultaneously supporting a shower curtain and a spaced-apart liner.

Background Art

It is well known to suspend a shower curtain made of sheet material by engaging it with a plurality of hangers, also referred to as hooks and sometimes called rings, which wrap at least partly around a horizontal rod or bar running across the opening to a shower enclosure. The hangers are movable along the length of the rod, so the user can slide the curtain horizontally, for access to the enclosure and for bringing the edges of the curtain close to the sides of the enclosure to prevent water from splashing out of the enclosure. It is also well known to have a liner associated with a shower curtain. A liner is a sheet of material that is placed inboard of the primary shower curtain so that it hangs in parallel with the curtain. Often a liner is the water shedding part of a shower curtain system and the curtain presents a decorative appearance. A liner may be removed and separately cleaned or replaced over time. Curtains and liners ordinarily have a series of spaced-apart openings or eyelets along their upper ends, so the openings can be engaged with the ends of a plurality of hangers positioned on a curtain rod.

A variety of hangers have been used for suspending shower curtains, with and without liners and similar hangers have been used to hang draperies, some examples of which are disclosed below:

U.S. Pat. No. 1,451,754 to Angevine (hereinafter Angevine) discloses a drapery hanger which can be sewn to the edges of two draperies. The hanger includes two vertical strips between which is a spindle which supports a roller that rolls on the top surface of a drapery rod. The two draperies must be sewn to the strips by a seamstress with stitches. Angevine does not disclose the manner in which the draperies and multiple hangers are installed on a drapery rod. It is not readily apparent that this is easily done. On the contrary, it appears to be very difficult to accomplish such a task.

U.S. Pat. No. 2,045,007 to Carpenter (hereinafter Carpenter) discloses a curtain suspension device to hang a curtain from a tubular curtain rod. The device consists of a single flexible strap member upon which are mounted two concave rollers arranged above and below the horizontally-disposed curtain rod. The rollers are supported on spindles attached to the flexible strip. A hook attached to the bottom of the strip supports a single curtain via a grommet at each of multiple locations along the top edge of the curtain. The minimum distance between the upper and lower companion rollers is slightly less than the diameter of the tubular rod to which the rollers are applied. The strap is flexible enough to permit the roller members to be applied laterally to the curtain rod at any point by pressing them against the rod and snapping them into place above and below the rod. Only a single curtain can be supported by the hanger. Pressing the rollers laterally against the rod has the potential to detach the rod from the enclosure wall.

U.S. Pat. No. 9,578,995 by Hanley (hereinafter Hanley) discloses a hanger for a shower curtain including two opposing direction hooks and a captive roller for riding along the top half of a curtain rod. The base part of the hanger has a hub from which projects both a spindle (in one direction, e.g., horizontally), and a shank in a second direction (e.g., downwardly). At the end of the shank of the base are a hook and a cradle that lie in the same plane and extend in opposite directions. A roller is mounted on the spindle and kept on the spindle by means of the cap of a closure. The closure comprises a shank that extends from the cap in a direction which is transverse to the spindle. There is a hook at the outer end of the closure shank; that hook has an outer convex curve surface which fits within the concave curve of the cradle. The closure of a preferred embodiment hanger is rotatable about the lengthwise axis of the spindle and the foregoing fit of hook and cradle is achieved when the hook is in the home position. When the shank of the closure is rotated away from the cradle, that creates an opening to the space within the interior of the hanger, so that the hanger can be placed on a rod; the closure is then rotated back to its home position. When the hook of the closure is positioned within the hole of a curtain or liner, that restrains the hook from moving away from the cradle. However, there is an opportunity for this hanger to inconveniently come off the rod if the hanger tilts when the user pulls on the curtain when opening or closing the curtain. End nubs on the ends of the hooks reduce the likelihood of the curtain coming off the hooks when the curtain is pulled to open or close it with respect to the shower envelope, but the curve of the hooks is gradual and this likely causes the hanger to tilt, increasing the opportunity for the hanger to detach from the rod. There is no infection point on the hook to center and restrain the curtain on the hook. The cradle is replaced with a nub, in one embodiment of Hanley. This is a potential wear part that is prone to fail after repeated use. One of the other drawbacks in Hanley's design lies in its complexity with all parts of three-dimensional geometry.

There exists a need for hangers which may be constructed or assembled with fewer and simpler parts, hangers which operate smoothly, hangers which are not prone to derail or detach from the rod to which the hangers are coupled and hangers which are not prone to permit accidental detachment of the curtain or liner from the hooks.

SUMMARY OF THE INVENTION

In accordance with the present invention, there is provided a hanger for suspending a first article and a second article on a rod, the hanger including:

(a) a roller;

(b) a supporting structure configured for supporting the roller; and (c) a pair of hooks extending from the supporting structure, wherein at least one of the hooks includes an inflection point to receive one of the first article and the second article, wherein the roller is coupled with the supporting structure to enable rolling of the hanger along the rod, the first article and the second article are each suspended by the pair of hooks.

In one embodiment, the inflection point is an angle of at least about 22.5-135 degrees. In one embodiment, the hanger further includes a pair of prongs each extending from the supporting structure and a roller including a pair of opposingly-disposed receptacles, each receptacle configured to receive one of the prongs. In one embodiment, the roller includes a width, each prong includes a length and the ratio of the width to the length is about 1/4.7. In one embodiment, the supporting structure is a U-shaped structure, wherein the roller is coupled with the U-shaped structure about the rod to form a gap around the rod to enable rolling of the hanger along the rod with limited departure from the rod. The rod includes a radius. In one embodiment the ratio of the gap to the radius is about 0.16-0.19. In one embodiment, the roller includes a widthwise cross-sectional profile such that the roller contacts the rod at only two points. The roller can be constructed from Polylactic Acid (PLA), Acrylonitrile Butadiene Styrene (ABS), Acrylic Polycarbonate (PC) or any combinations thereof. In one embodiment, the hooks are symmetrically disposed about a central plane through the supporting structure.

An object of the present invention is to provide a hanger which functions smoothly without fail and a plurality of such hangers that do not derail easily while the curtain the plurality of such hangers support is pulled on.

Another object of the present invention is to provide a hanger having few to no wear components.

Another object of the present invention is to provide a hanger which functions consistently when the curtain it supports is pulled on, reducing or eliminating the possibility that bunching of portions of the curtain can occur.

Another object of the present invention is to provide a hanger which functions quietly with little resistance when the curtain it supports is pulled on.

Another object of the present invention is to provide a hanger which functions consistently when the curtain it supports is pulled on, reducing or eliminating the possibility that the curtain detaches from the hanger hook.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
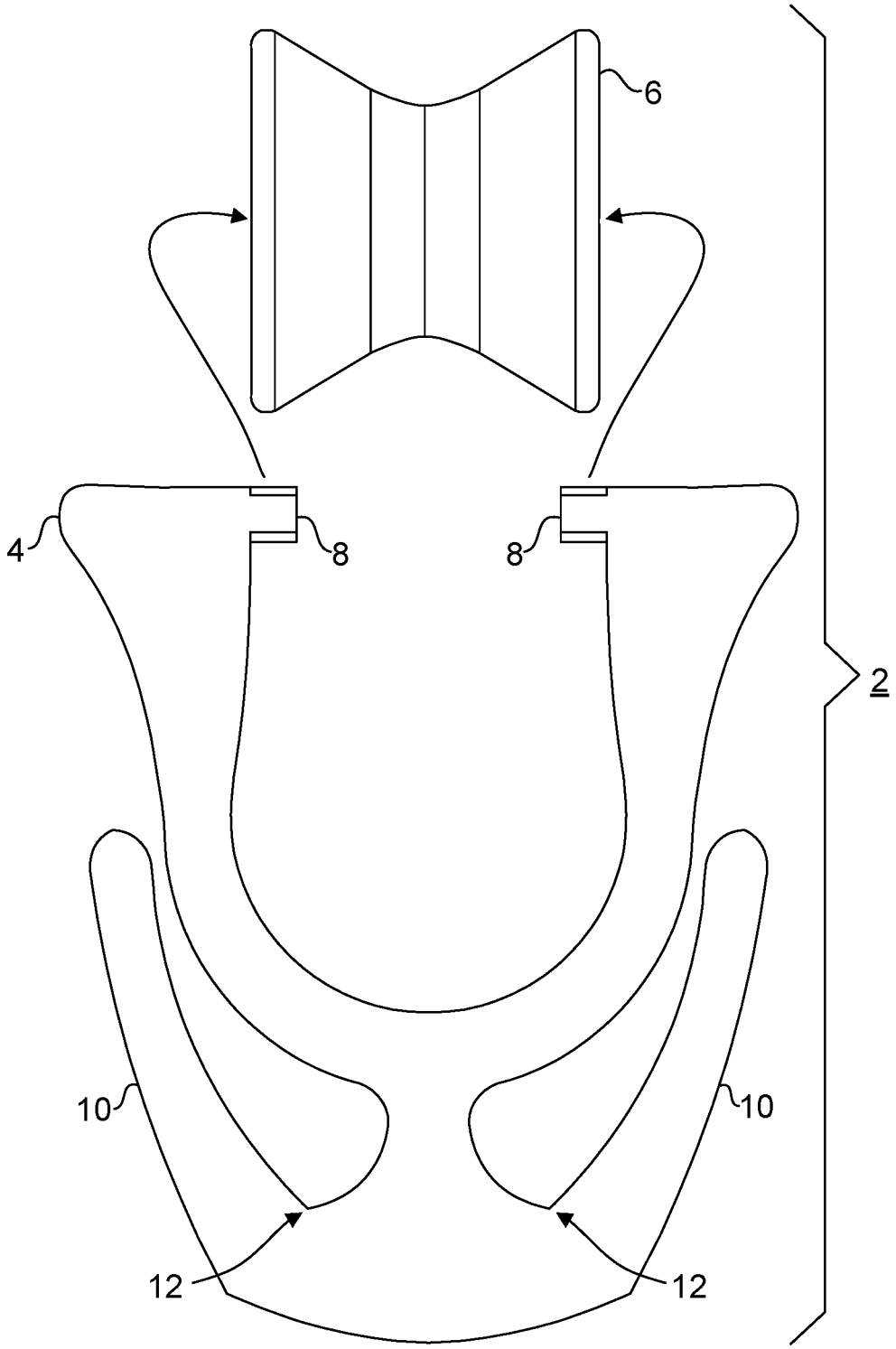
FIG. 1 is a front view of a roller and a supporting structure configured to be coupled to the roller according to one embodiment of the present hanger.

2—hanger
4—supporting structure
6—roller
8—prong
10—hook
12—inflection point
14—gap
16—point of contact
18—angle
20—profile of roller
22—central plane
24—eyelet
26—first article
28—second article
30—receptacle
32—rod
34—opening
36—shoulder
38—horizontal distance between sheet and edge of shoulder
40—width of roller
42—length of prong
44—thickness of supporting structure

PARTICULAR ADVANTAGES OF THE INVENTION

The present hanger can be securely attached around a rod to support a portion of the weight of two articles one on each side of the hanger and it does not derail and detach altogether from the rod on which the hanger is installed when a tucking or pulling force is applied imperfectly on at least one of the two articles, i.e., when the tucking or pulling force is not aligned perfectly in a direction to cause the movement of the hanger in a desired direction. Therefore, the user can use the articles, e.g., shower curtain and liner supported on the hanger without fear of detaching at least one of them from the rod upon which the articles were supported and having to re-seat the hanger on the rod. The present hanger can be securely attached around a rod to support a portion of the weight of two articles one on each side of the hanger while allowing the hanger to traverse the rod smoothly without excessive friction that can cause one or more of a plurality of such hangers that support the two articles to derail and stop functioning properly.

The present hanger includes only two parts, a flat supporting structure and a cylindrical roller. Both parts are easy to manufacture by three-dimensional (3D) printing or injection molding and intuitive to assemble and install on a rod. To support a shower curtain and a liner, a plurality of the present hangers are used to support articles in the form of sheets with each hanger bearing a portion of the weight of the shower curtain and the liner. By unseating the prongs from the receptacles in the roller, the hangers and attached curtain and liner can be easily detached from the rod for cleaning. To detach a hanger from a rod, one is merely required to pull one prong against the roller in a direction away from the roller such that the roller can be freed from the hanger, releasing the rod from being confined within a supporting structure coupled with a roller.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Shower curtains are commonly used to prevent water from splashing outside the bathing area while additionally providing aesthetic value and privacy to their users. Traditional shower curtain hanger systems often consist of basic hooks or rings attached to a curtain rod, which can lead to various issues such as instability, difficulty in curtain attachment and detachment and unappealing aesthetics. In many cases, users experience the frustration of a curtain falling off its hangers or hangers falling off their rod during use, resulting in wet floors and frustrating showering experiences.

To address these drawbacks, there have been attempts to improve the design and functionality of shower curtain hanger systems. These include mechanisms such as snap-on hooks, adjustable clips, double-hook arrangements and rollers on spindle as employed by Hanley, Carpenter and Angevine. However, these solutions often present their own challenges, including complicated installation, limited adaptability to different curtain types, instability of the hanger on rod and a propensity to cause wear and tear on the curtain material. Thus, there is a need for a novel shower curtain hanger system that overcomes the limitations of existing solutions and provides enhanced stability, ease of use and aesthetic integration with modern bathroom environments.

Figure 2:
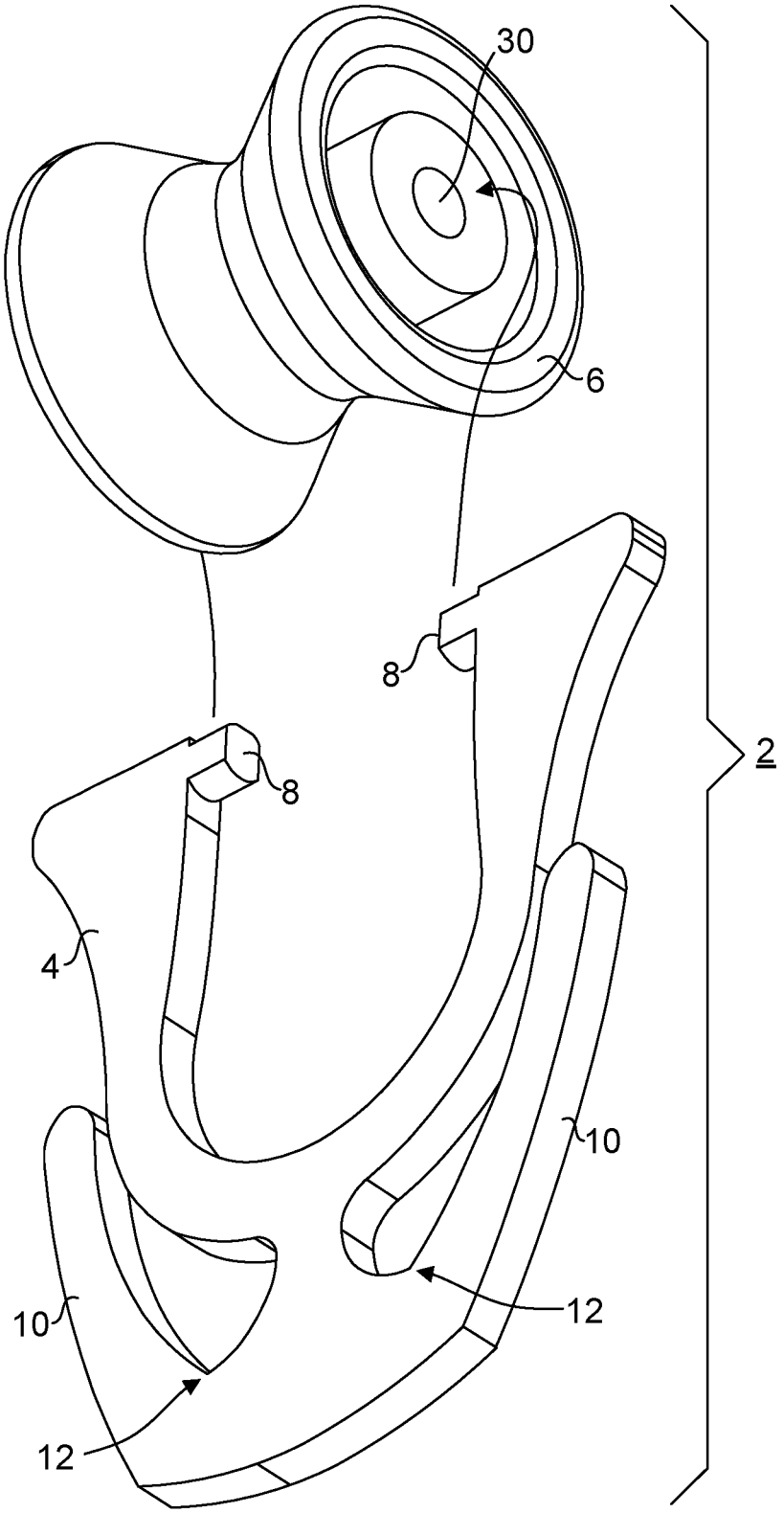
FIG. 2 is a bottom front perspective view of a roller and a supporting structure configured to be coupled to the roller according to one embodiment of the present hanger.
Figure 3:
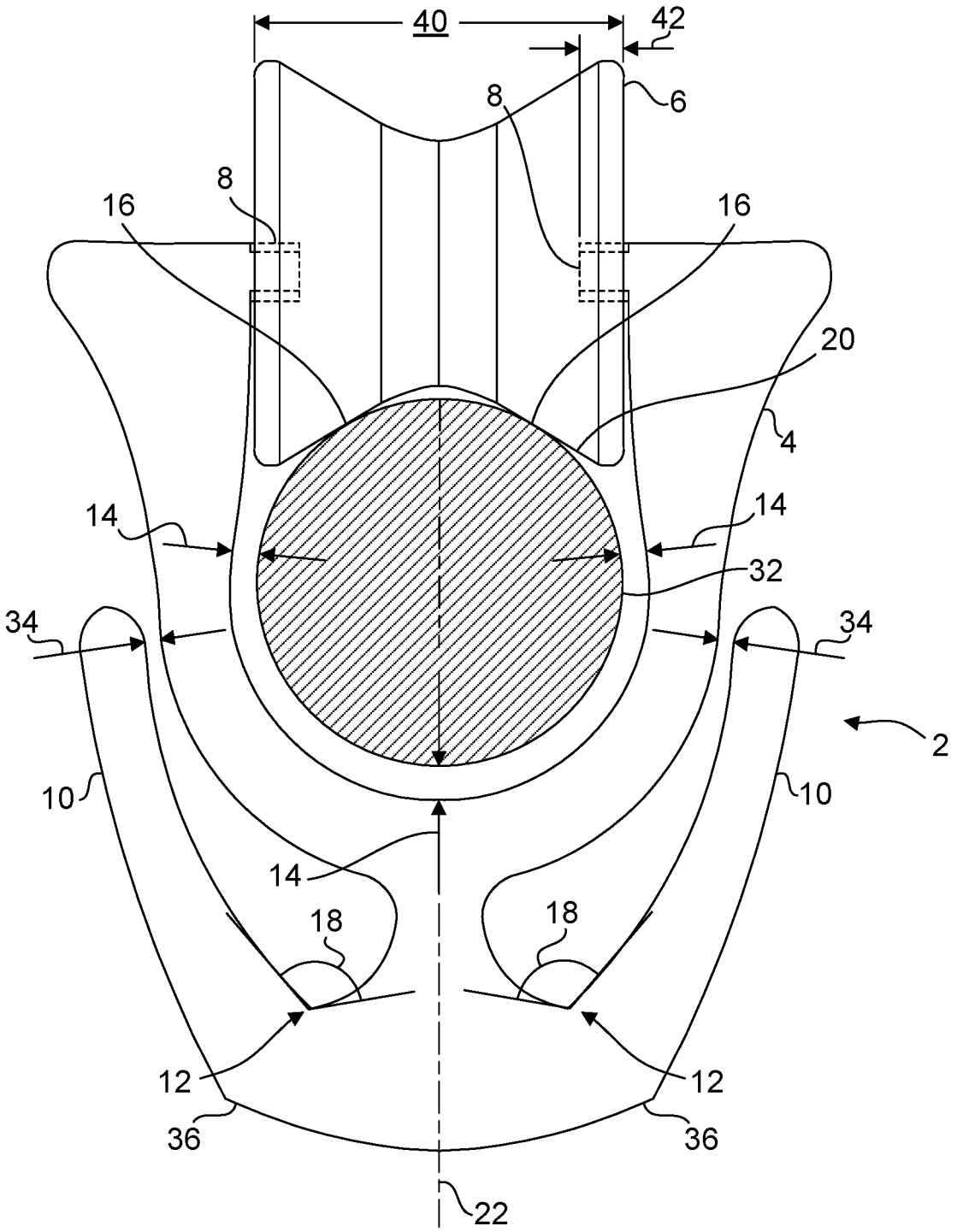
FIG. 3 is a front view of a roller and a supporting structure configured to be coupled to the supporting structure, depicting the supporting structure having been coupled to the roller according to one embodiment of the present hanger.
Figure 4:
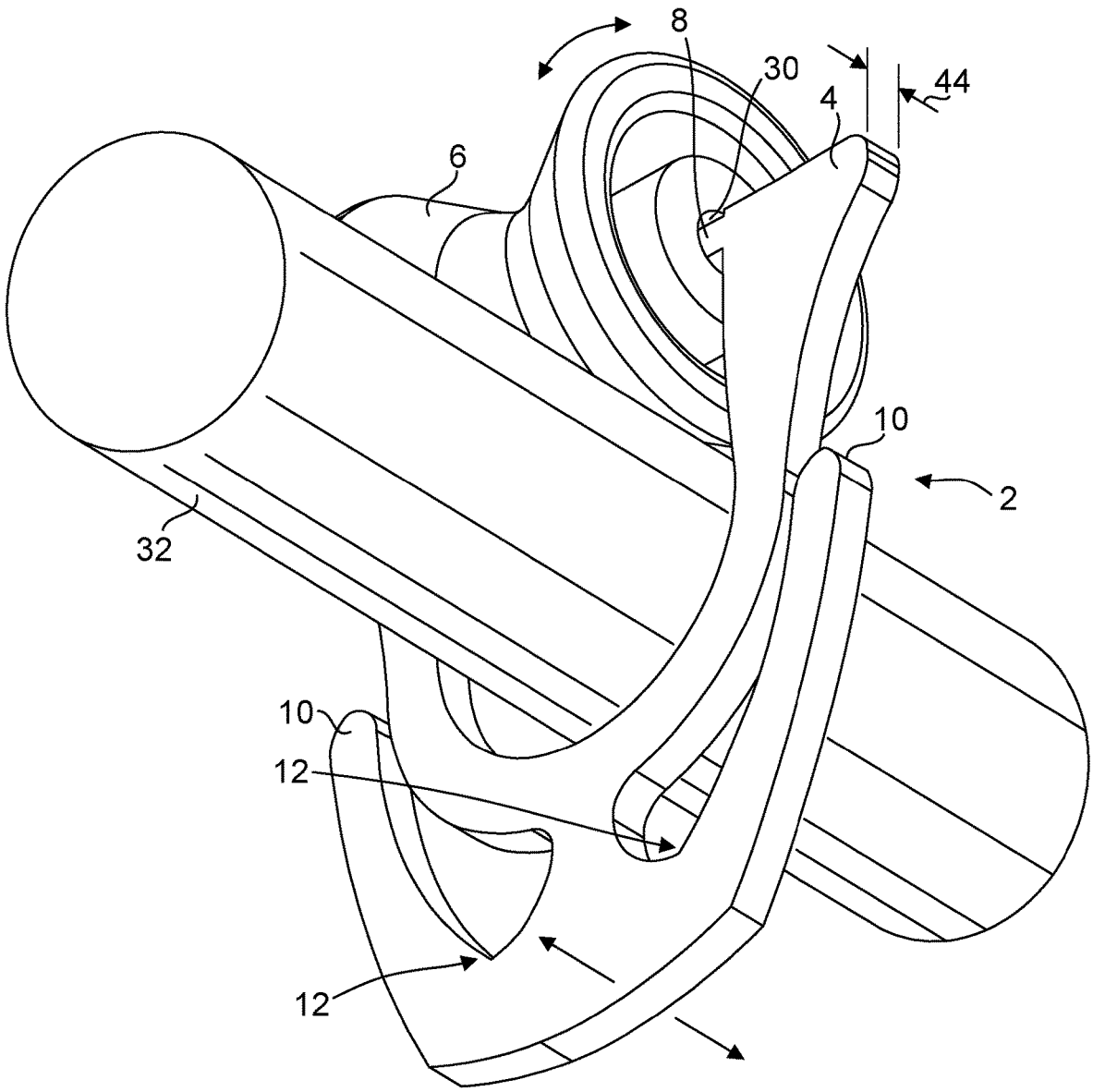
FIG. 4 is a bottom perspective view of a roller and a supporting structure configured to be coupled to the supporting structure, depicting the supporting structure having been coupled to the roller according to one embodiment of the present hanger.

FIG. 1 is a front view of a roller and a supporting structure 4 configured to be coupled to the roller according to one embodiment of the present hanger 2. FIG. 2 is a bottom front perspective view of a roller and a supporting structure 4 configured to be coupled to the roller according to one embodiment of the present hanger 2. FIG. 3 is a front view of a roller and a supporting structure configured to be coupled to the supporting structure, depicting the supporting structure having been coupled to the roller according to one embodiment of the present hanger 2. FIG. 4 is a bottom perspective view of a roller and a supporting structure 4 configured to be coupled to the supporting structure, depicting the supporting structure 4 having been coupled to the roller according to one embodiment of the present hanger 2. Shown herein is a single hanger for ease of description of the ensuing embodiments. In a typical application, a plurality of hangers, e.g., a dozen, are required. However, each hanger functions similarly to its adjacently-disposed hanger, i.e., to support a portion of the total weight of one or more sheets while allowing the one or more sheets to be suspended or moved along a rod 32. The hanger includes a roller 6, a supporting structure 4 configured for supporting the roller and a pair of hooks 10 extending from the supporting structure 4. Each hook 10 is configured to receive an article, e.g., a shower curtain or liner and includes an inflection point 12, a function of which would be apparent in the ensuing description. An inflection point, as used herein, is characterized by a valley in part having two side edges that are substantially rectilinear. In one embodiment, the inflection point includes an angle 18 of about 22.5-135 degrees. The roller 6 includes a width and is essentially a cylindrical component having a receptacle 30 disposed along a central axis on each widthwise end of the roller 6 providing a total of a pair of opposingly-disposed receptacles 30. The hanger 2 further includes a pair of prongs 8 extending inwardly from the supporting structure 4 towards one another. Each receptacle 30 is configured to receive one of the prongs 8. Each prong 8 preferably includes a length 42 sufficiently large to secure one end of the roller 6 but not too prominent as not to jeopardize the ease of attaching the roller 6 to the supporting structure 4 or detaching the roller 6 from the supporting structure 4. In one embodiment, the ratio of the width 40 of the roller 6 to the length 42 of the prong 8 is about 5.618 mm/26.5 mm or 1/4.7. In the embodiment shown, the supporting structure 4 is essentially a planar structure with two flat parallel surfaces and features that define a U-shape and the prongs 8 which protrude from the U-shape structure defined in two directions within these flat surfaces. The hanger can be installed on a rod 32 or taken off easily from a rod 32. To remove the hanger from a rod, a user simply unsnaps a prong 8 from a roller receptacle 30. To install the hanger around the rod 32, the prong 8 is re-snapped back in the receptacle 30. The supporting structure is preferably one which provides sufficient strength to support the roller 6 while allowing the arms of the structure from which the prongs 8 extend to bend in a direction perpendicular to the flat surfaces while being manipulated using one's fingers from both hands to allow a prong to be seated or reseated in a receptacle 30 of the roller 6. In contrast, Hanley's hanger is less intuitive for a user to install on a rod and requires one arm to be rotated 180 degrees in order to provide space for the roller to be slipped over the rod and then the arm must be rotated back to be secured in a cradle. The use of a roller secured with a pair of prongs 8 eliminates the need for a spindle, e.g., one disclosed in Hanley, Carpenter and Angevine. The use of a spindle to support a roller significantly increases the friction between the roller and the spindle to which the roller is coupled.

Figure 5:
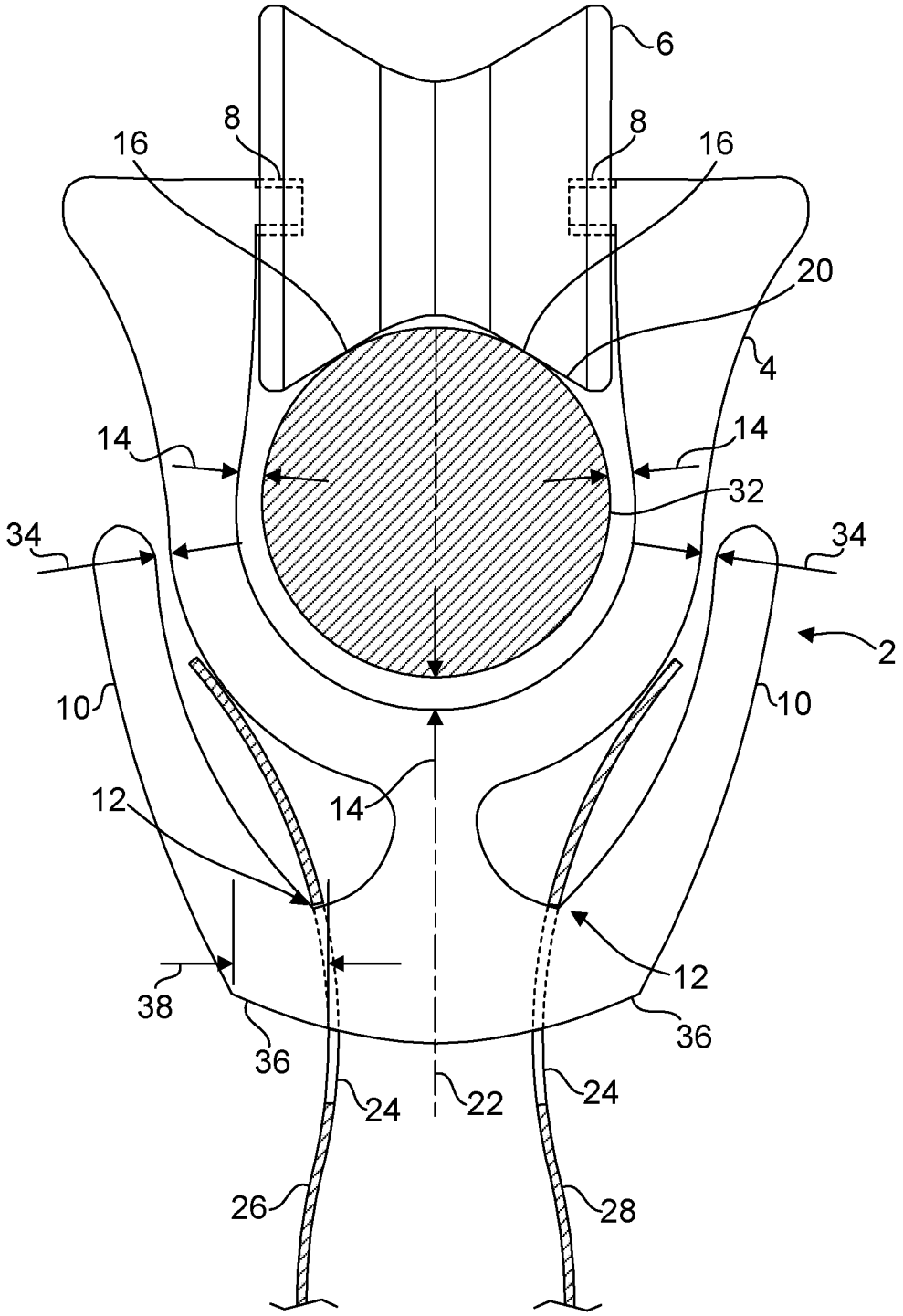
FIG. 5 is a front view of a roller and a supporting structure configured to be coupled to the supporting structure, depicting the supporting structure having been coupled to the roller and that a first article and a second article are being supported by the hanger according to one embodiment of the present hanger.

FIG. 5 is a front view of a roller and a supporting structure configured to be coupled to the supporting structure, depicting the supporting structure having been coupled to the roller and that a first article 26 and a second article 28 are being supported by the hanger 2 according to one embodiment of the present hanger. The hooks 10 are disposed symmetrically about a central plane 22 of the supporting structure 4 and therefore the first article 26 and the second article 28 can be interchangeably supported on either one of the hooks 10 equally distanced from the central plane 22 of the supporting structure 4. Each of the first article 26 and the second article 28 can be a shower curtain or a liner. By balancing the weight of the two articles 26, 28, the hanger 2 is less likely to tip in a direction about the rod 32 when the user pulls on the curtain to open and close it before and after showering. This reduces the possibility of the hanger 2 detaching from the rod although the gap 14 shown in FIG. 2 is already small, i.e., with the center of gravity of the hanger 2 already closely approximating the center of gravity of the rod. A pleasing appearance can be achieved by balancing the weight of the two articles 26, 28 to ensure that the articles hang in a vertical plane without tipping and sagging. A plurality of apertures, holes or eyelets 24 are disposed near a top edge of a shower curtain or a liner 26, 28 along the entire top edge to properly distribute the weight of the article 26, 28. In one embodiment, the supporting structure is a U-shaped structure, wherein the roller is coupled with the U-shaped structure about the rod to form a gap 14 around the rod 32 to enable rolling of the hanger 2 along the rod 32 with limited departure from the rod 32 if the roller 6 gets detached from the rod 32. The small gap 14 between the rod 32 and the supporting structure 4 causes the hanger 2 to tend to return to its operational position even when the roller 6 has lost contact momentarily with the rod 32, e.g., when inadvertently lifted by a sufficiently stiff installed liner 26, 28. A complete detachment of the installed hanger 2 due to normal use is highly unlikely as the hanger 2, while installed, positively surrounds the rod 32. The rod 32 typically comes in a diameter of 1-1.25 inches. In one embodiment, the ratio of the gap 14 to the radius of the rod is about 2.366 mm/15.0655 mm or 0.16 to 2.366 mm/12.7 mm or 0.19. In one embodiment, the roller includes a widthwise cross-sectional profile 20 such that the roller contacts the rod at only two points 16 as shown in FIGS. 3 and 5, severely reducing the friction imparted on the roller 6 by the rod 32 if the roller 6 becomes inadvertently locked in its rotary motion with respect to the prongs 8. By restricting the opening 34 made between a hook 10 and the supporting structure 4, an article 26, 28 disposed in the hook 10 can be retained. By disposing a shoulder 36 in the part of the supporting structure 4 prior to extending it into a hook 10 at an angle to the shoulder 36, the shoulder 36 prevents an inadvertently lifted article 26, 28 from easily exiting the hook 10 as the bottom portion of the eyelet 24 would come into contact with the shoulder 36 if the article 26, 28 is lifted vertically. In order to remove an article 26, 28 at an eyelet 24 from a hook 10, a user would need to consciously align the eyelet 24 with the hook 10, reducing the possibility that the article 26, 28 can be inadvertently detached. In one embodiment, the horizontal distance 38 between an article 26, 28 and an edge of a shoulder 36 is about 0.28 inches. In one embodiment, the width 40 of the roller 6 is about 1 inch. In one embodiment, the length 42 of a prong 8 is about 0.22 inches. In one embodiment, the thickness 44 of supporting structure 4 is about 0.16 inches. The roller 6 and the supporting structure 4 can be constructed from Polylactic Acid (PLA), Acrylonitrile Butadiene Styrene (ABS), Acrylic, Polycarbonate (PC) or any combinations thereof. Other moldable plastics may be considered. Either a roller 6 and/or a supporting structure 4 may be constructed in various colors or surface patterns for aesthetic purposes.

Figure 6:
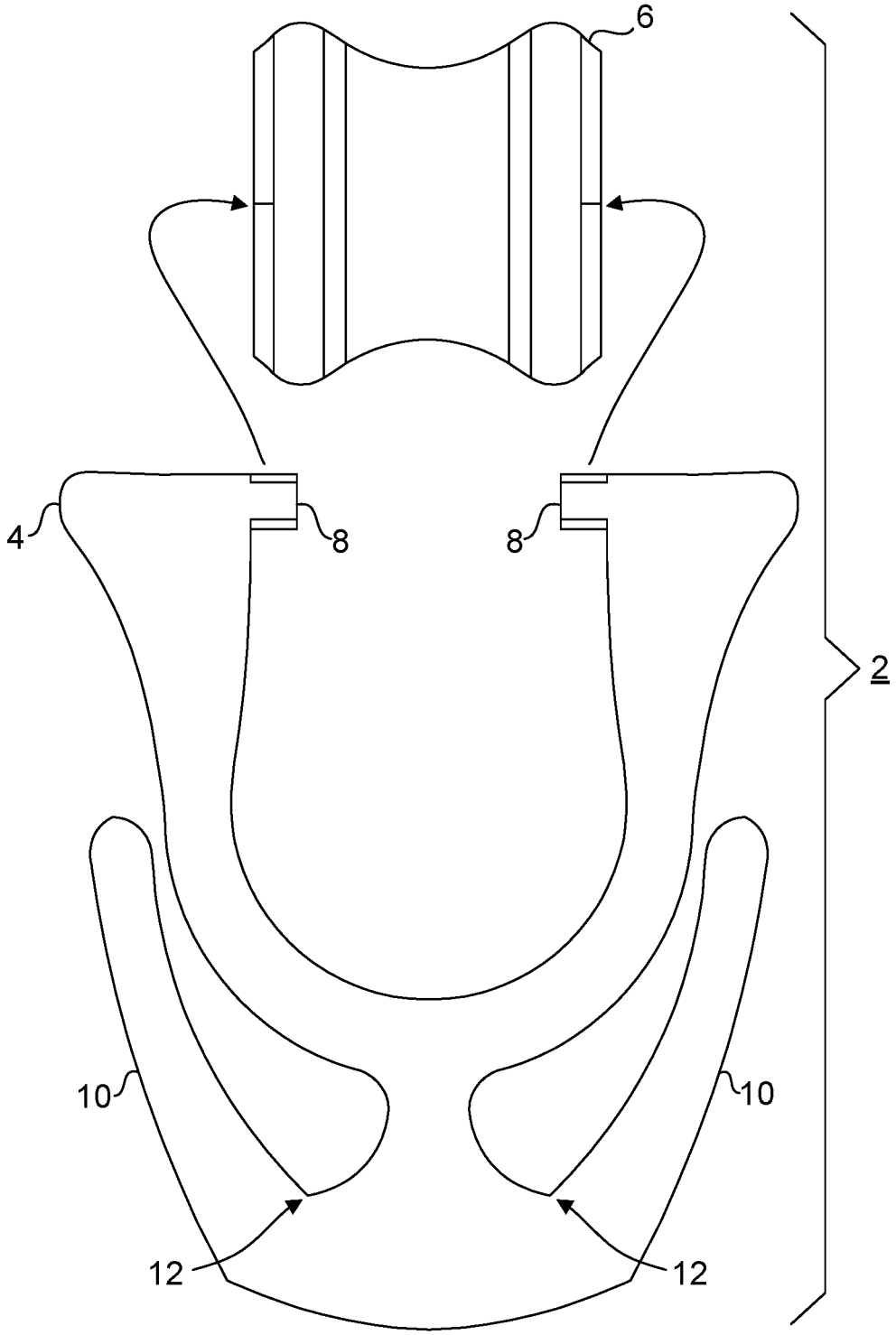
FIG. 6 is a front view of a roller and a supporting structure configured to be coupled to the roller according to one embodiment of the present hanger.
Figure 7:
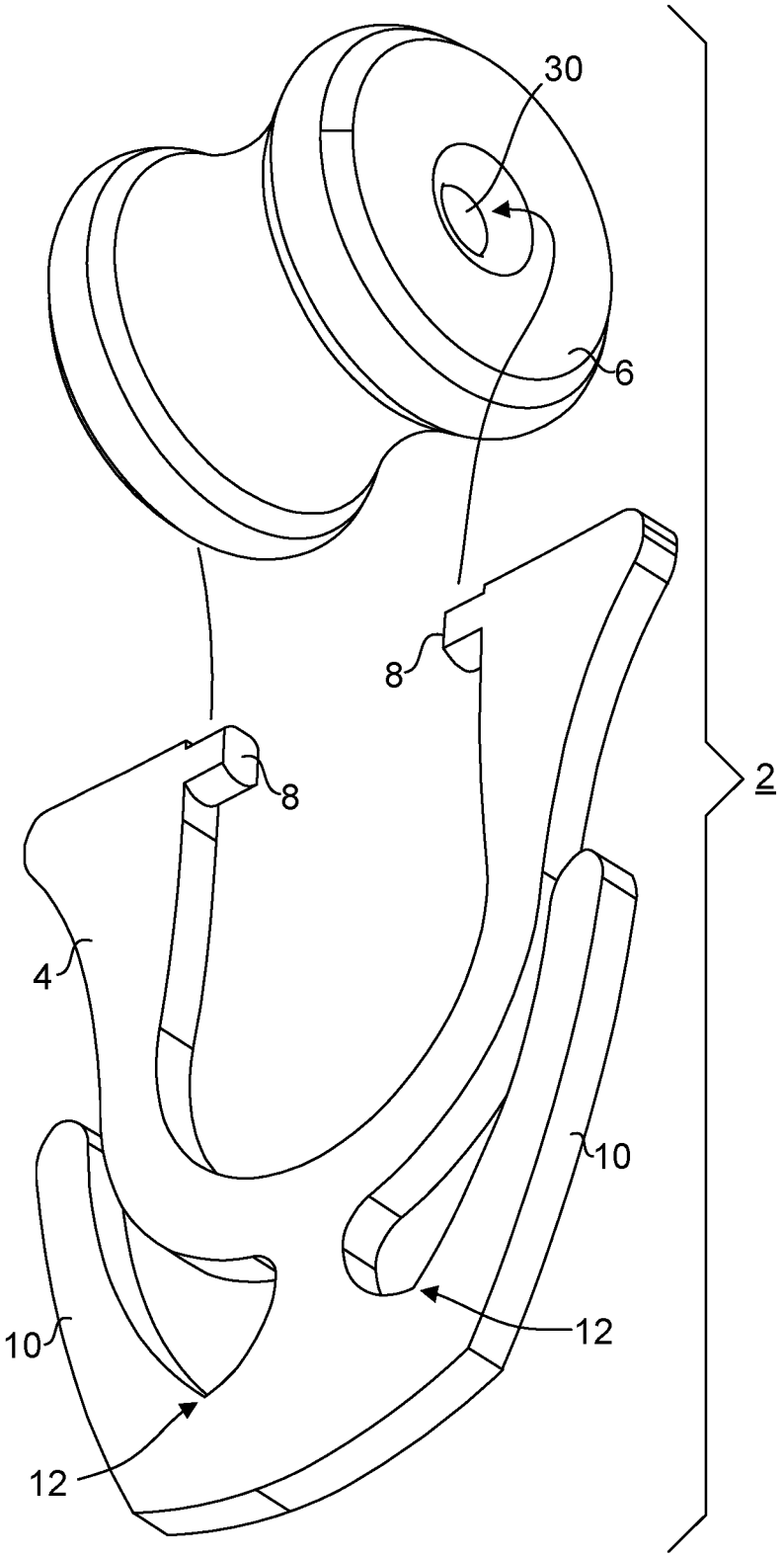
FIG. 7 is a bottom front perspective view of a roller and a supporting structure configured to be coupled to the roller according to one embodiment of the present hanger.
Figure 8:
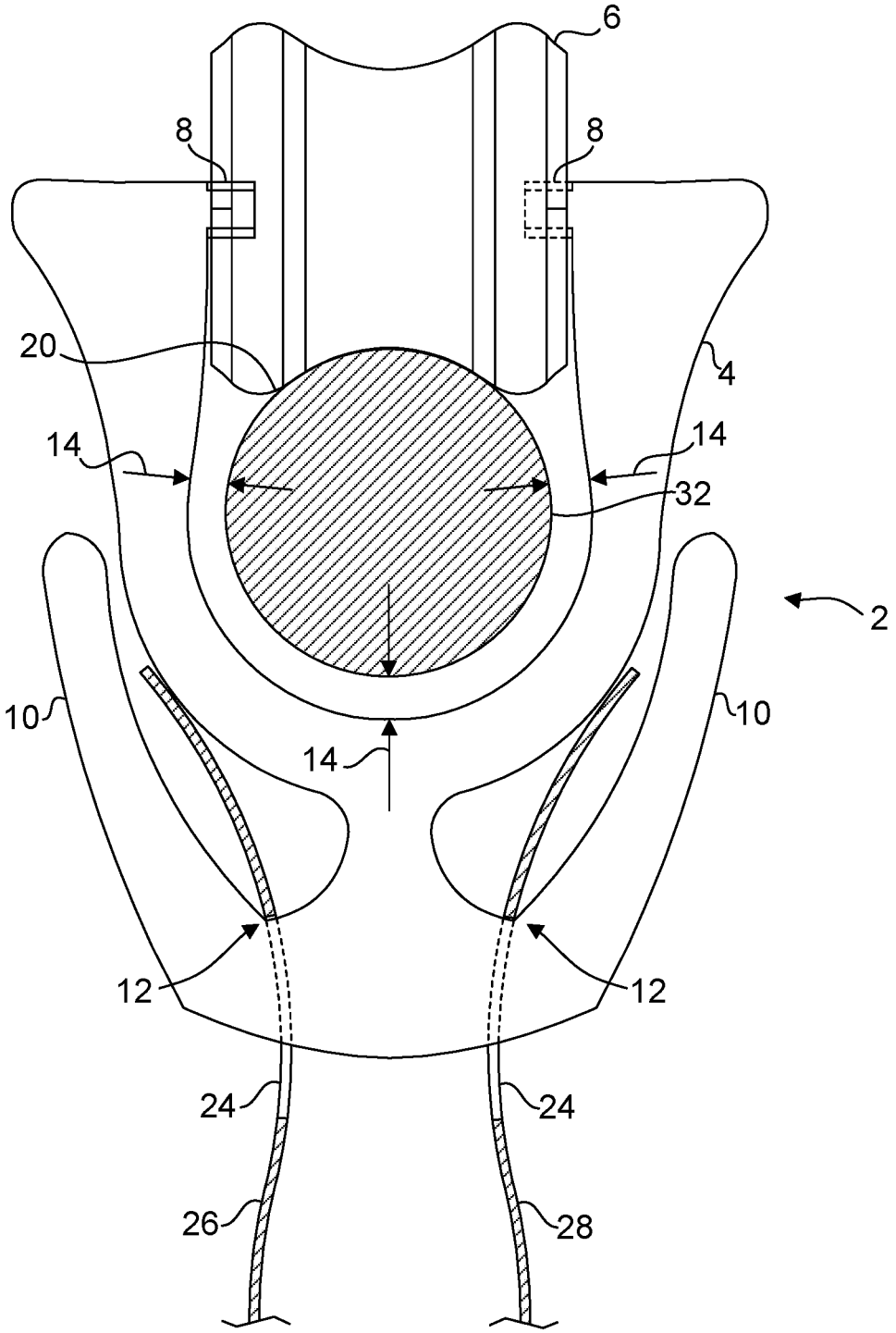
FIG. 8 is a front view of a roller and a supporting structure configured to be coupled to the supporting structure, depicting the supporting structure having been coupled to the roller according to one embodiment of the present hanger.
Figure 9:
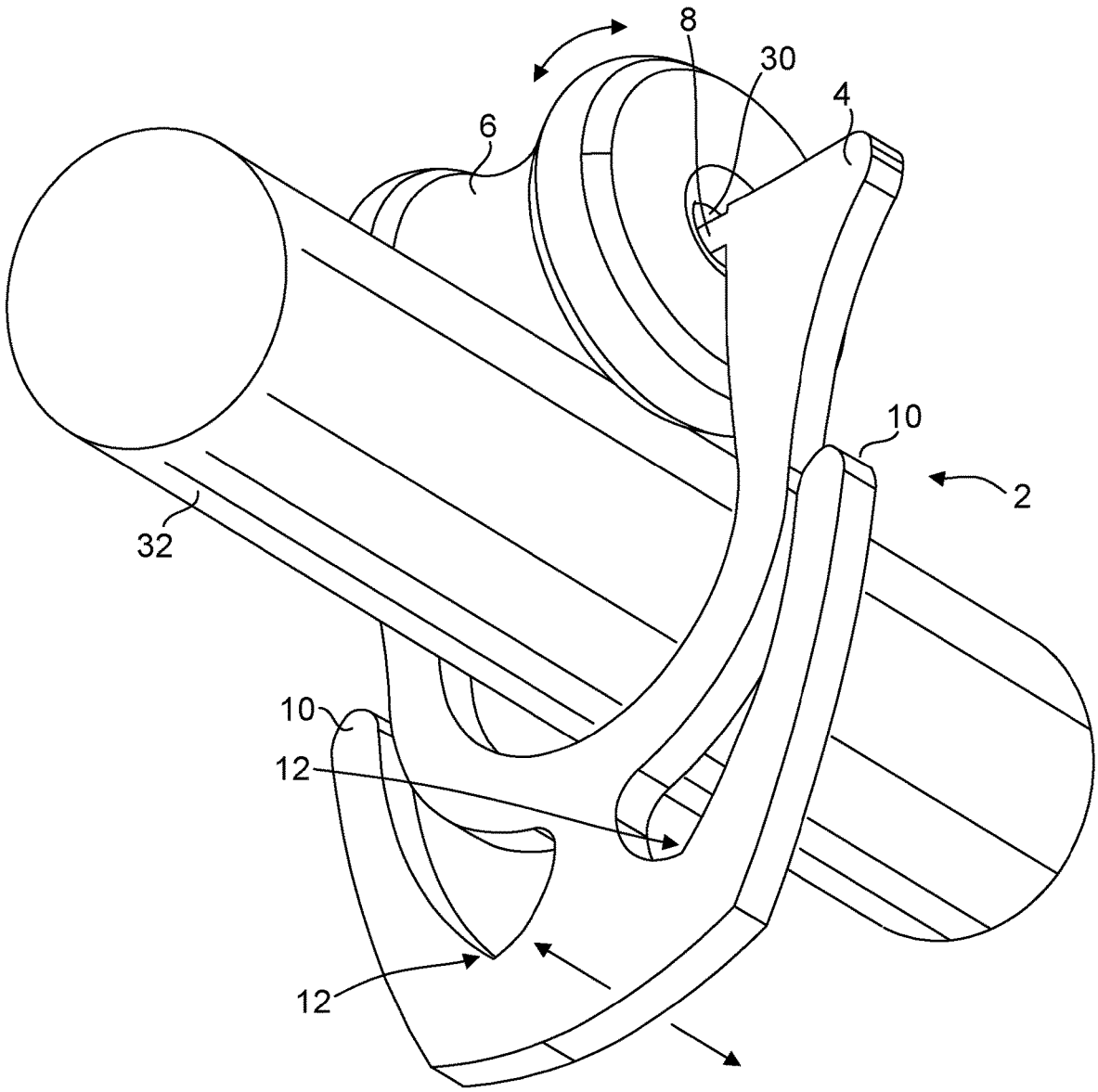
FIG. 9 is a bottom perspective view of a roller and a supporting structure configured to be coupled to the supporting structure, depicting the supporting structure having been coupled to the roller according to one embodiment of the present hanger.

FIG. 6 is a front view of a roller and a supporting structure configured to be coupled to the roller according to one embodiment of the present hanger. FIG. 7 is a bottom front perspective view of a roller and a supporting structure configured to be coupled to the roller according to one embodiment of the present hanger. FIG. 8 is a front view of a roller and a supporting structure configured to be coupled to the supporting structure, depicting the supporting structure having been coupled to the roller according to one embodiment of the present hanger. FIG. 9 is a bottom perspective view of a roller and a supporting structure configured to be coupled to the supporting structure, depicting the supporting structure having been coupled to the roller according to one embodiment of the present hanger. Instead of contacting the rod 32 at two points as shown in FIGS. 3 and 5, the roller 6 shown in FIGS. 6-9 assumes a profile that more closely matches the rod 32 profile for about a quarter of the circumference of the rod 32. This roller profile was found to be providing a roller-rod contact that is even quieter when a roller 6 along the rod 32 than the profile shown in FIGS. 3 and 5.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A hanger for suspending a first article and a second article on a rod, said hanger comprising:

(a) a roller;

(b) a supporting structure configured for supporting said roller;

(c) a pair of prongs each extending from said supporting structure and said roller comprises a pair of opposingly-disposed receptacles, each said receptacle configured to receive a prong of said pair of prongs, each said prong comprises a width and a length and a ratio of said width to said length is about 1/4.7; and (d) a pair of hooks extending from said supporting structure, wherein at least one of said hooks comprises a valley bounded by two substantially rectilinear side edges to receive one of the first article and the second article, wherein said roller is coupled with said supporting structure to enable rolling of said hanger along the rod, the first article and the second article are each suspended by said pair of hooks.

2. The hanger of claim 1, wherein said two substantially rectilinear side edges form an angle of about 22.5-135 degrees.

3. The hanger of claim 1, wherein said supporting structure is a U-shaped structure, wherein said roller is coupled with said U-shaped structure about the rod to form a gap around the rod to enable rolling of said hanger along the rod with limited departure from the rod.

4. The hanger of claim 3, wherein the rod comprises a radius and the ratio of said gap to the radius is about 0.16-0.19.

5. The hanger of claim 1, wherein said roller comprises a widthwise cross-sectional profile such that said roller contacts the rod at only two points.

6. The hanger of claim 1, wherein said roller is constructed from a material consisting of Polylactic Acid (PLA), Acrylonitrile Butadiene Styrene (ABS), Acrylic, Polycarbonate (PC) and any combinations thereof.

7. The hanger of claim 1, wherein said hooks are symmetrically disposed about a central plane through said supporting structure.

8. A hanger for suspending a first article and a second article, said hanger comprising:

(a) a rod;

(b) a U-shaped structure;

(c) a pair of prongs each extending from said U-shaped structure;

(d) a roller comprising a pair of opposingly disposed receptacles, each said receptacle configured to receive each said prong; and (e) a pair of hooks extending from said U-shaped structure, wherein said roller is coupled with said U-shaped structure by said pair of prongs about the rod to form a gap around the rod to enable rolling of said hanger along the rod with limited departure from the rod, the first article and the second article are each suspended by said pair of hooks on the rod and the rod comprises a radius and the ratio of said gap to the radius is about 0.16-0.19.

9. The hanger of claim 8, wherein at least one of said hooks comprises an inflection point to receive one of the first article and the second article.

10. The hanger of claim 9, wherein two substantially rectilinear side edges form an angle of about 22.5-135 degrees.

11. The hanger of claim 8, wherein said roller comprises a width, each said prong comprises a length and the ratio of said width to said length is about 1/4.7.

12. The hanger of claim 8, wherein said roller comprises a widthwise cross-sectional profile such that said roller contacts the rod at only two points.

13. The hanger of claim 8, wherein said roller is constructed from a material consisting of Polylactic Acid (PLA), Acrylonitrile Butadiene Styrene (ABS), Acrylic, Polycarbonate (PC) and any combinations thereof.

14. The hanger of claim 8, wherein said hooks are symmetrically disposed about a central plane through said U-shaped structure.

* * * * *